United States Patent [19]

Theurer

[11] 4,046,078

[45] Sept. 6, 1977

[54] TRACK SURFACING APPARATUS

[75] Inventor: Josef Theurer, Vienna, Austria

[73] Assignee: Franz Plasser Bahnbaumaschinen-Industriegesellschaft m.b.H., Vienna, Austria

[21] Appl. No.: 652,475

[22] Filed: Jan. 26, 1976

Related U.S. Application Data

[63] Continuation-in-part of Ser. No. 644,638, Dec. 29, 1975.

[30] Foreign Application Priority Data

Jan. 31, 1975 Austria ..... 738/75
Mar. 5, 1975 Austria ..... 1716/75

[51] Int. Cl.[2] ..... E01B 27/17; E01B 29/04

[52] U.S. Cl. ..... 104/7 R; 104/8; 104/12

[58] Field of Search ..... 104/2, 7 R, 7 B, 8, 104/12

[56] References Cited

U.S. PATENT DOCUMENTS

| | | | |
|---|---|---|---|
| 3,762,333 | 10/1973 | Theurer et al. | 104/7 R X |
| 3,796,160 | 3/1974 | Waters et al. | 104/7 R |
| 3,808,976 | 5/1974 | Stewart | 104/12 |
| 3,811,382 | 5/1974 | Buchter et al. | 104/7 R |
| 3,926,123 | 12/1975 | Plasser et al. | 104/7 R |

*Primary Examiner*—Robert J. Spar
*Assistant Examiner*—Randolph A. Reese
*Attorney, Agent, or Firm*—Kurt Kelman

[57] ABSTRACT

A mobile apparatus for dynamically stabilizing a ballast bed supporting a track at a desired level comprises a reference for determining a deviation of the track grade from the desired level, and at least two track stabilization units spaced from each other in the direction of track elongation. Each unit includes a chassis running on the track rails on flanged wheels, vibrators for imparting at least approximately horizontal vibrations to the track engaged by the flanged wheels, a mechanism for laterally pressing the flanged wheels into play-free engagement with their associated rails, and loads associated with each rail and supplemental to the weight of the apparatus for imparting a pressure to the rails in the direction of the ballast bed whereby the vibrating track is pressed to a lower level.

10 Claims, 6 Drawing Figures

TRACK SURFACING APPARATUS

This is a continuation-in-part of my copending patent application Ser. No. 644,638, filed Dec. 29, 1975 and also entitled "Track Surfacing Apparatus".

The present invention relates to improvements in a mobile apparatus for compacting ballast of a ballast bed supporting a track consisting of two rails fastened to ties resting on the ballast.

Dynamic track stabilization has been proposed in U.S. Pats. Nos. 3,919,943, dated Nov. 18, 1975, and 3,926,123, dated Dec. 16, 1975, disclosing a mobile apparatus of this type which comprises means for determining a deviation of the track position from a desired level, and a track stabilization unit including a chassis having a running gear including rail engaging and guiding means associated with each of the rails and mounting the chassis for mobility on the track, means for imparting at least approximately horizontal vibrations to a section of the track engaged by the rail engaging and guiding means, the vibration imparting means including the rail engaging and guiding means and a vibration producing means, and load means supplemental to the weight of the apparatus in the region of the vibration imparting means for imparting a pressure to both rails of the track in the direction of the ballast bed whereby the track is pressed to a lower level which preferably is the desired level of the track.

In my above-identified application, I have disclosed a mechanism in such a track stabilization unit for simultaneously laterally pressing the rail engaging and guiding means associated with each rail without play against the rail with which it is associated.

The advantages obtained by such track stabilization units have been outlined in the patents and patent application. It is the primary object of this invention further to improve the effectiveness of track surfacing with dynamic track stabilization.

The above and other objects are accomplished in accordance with the invention by arranging two or more track stabilization units spaced from each other in the direction of track elongation.

Unexpectedly, this improved arrangement not only doubles or multiplies the vibratory force according to the number of units used but produces a particularly homogenous and uniform ballast compaction. This new technique of track surfacing, wherein a preferably leveled and tamped track is lowered to a controlled level at which it is dynamically stabilized, is most advantageously practiced with a plurality of track stabilization units which are effective over a relatively long track section and leave a continuously and uniformly surfaced track bed. Furthermore, when a plurality of track stabilization units are used with a track tamping machine with multiple-tie tamping tool assemblies, the required load for imparting a downward pressure to both track rails is considerably lower than that to which the track is subjected by passing trains. Also, a variety of arrangements may be selected to modify the transmission of the vibrations and downward pressure to the track. For instance, the track stabilization units may be closely spaced along the track but they may also be arranged on either side of an undercarriage supporting the apparatus for mobility on the track. The vibratory forces and downward pressure loads may be varied to adapt the surfacing to expected train loads and to vary the extent of the downward settling of the track. In addition, since the vibratory forces and loads are distributed over more than one unit, each force and load may be smaller so as to make certain that the rail fastening elements remain undamaged.

The above and other objects, advantages and features of the present invention will become more apparent from the following detailed description of certain now preferred embodiments thereof, taken in conjunction with the accompanying drawing wherein FIG. 1 is a side view of a track tamping, leveling and lining machine combined with a track stabilization apparatus;

Figure 1:
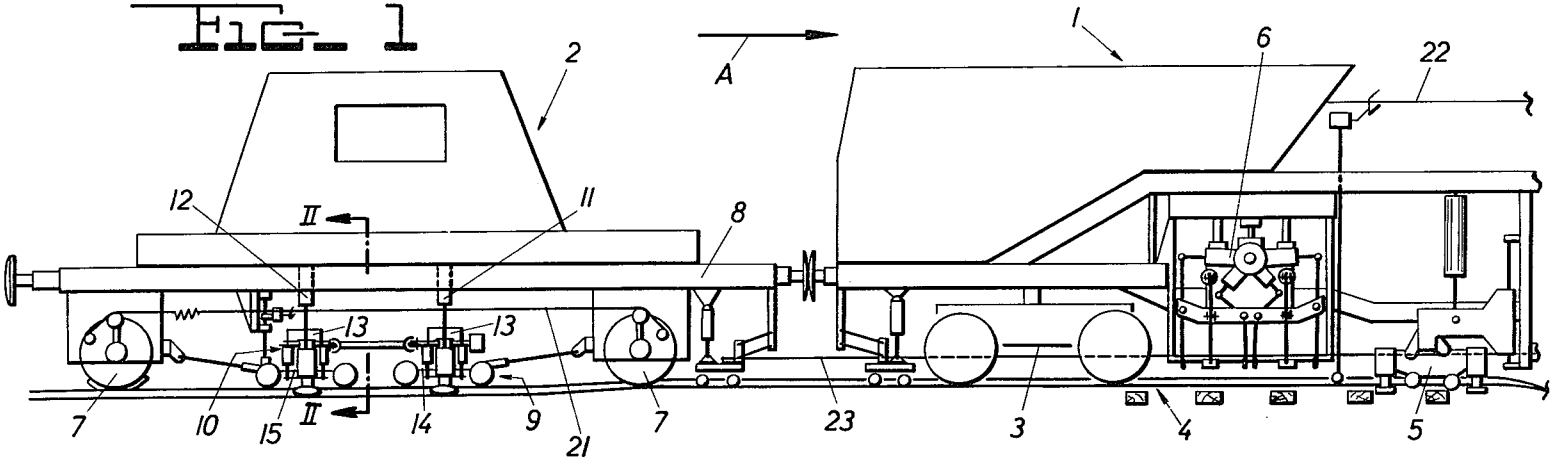

Referring now to the drawing and first to FIG. 1, there is shown conventional mobile track tamper 1 designed for leveling and lining track 4 consisting of two rails fastened to ties resting on ballast, and comprising tamping tool assembly 6 for simultaneously tamping two ties. The tamping tool assembly is of the known type comprising two pairs of opposed reciprocatory tamping tools and additional reciprocatory tamping tools arranged for a tamping movement transversely of the track towards the ends of the ties. As is also well known, the tamper comprises a track lifting and lining unit 5 for raising the track and/or transversely moving it under the respective control of reference 22 and/or reference 23, the track being fixed in the leveled and lined positioned by asynchronously tamping the ties. All of this structure and its operation being known, they require no further description or detailed illustration.

In accordance with this invention, track stabilization apparatus 2 is coupled to mobile machine 1. This apparatus comprises frame 8 mounted on undercarriages 7, 7 for mobility on track 4, the combined machine 1 and apparatus 2 moving in a working direction indicated by arrow A. As shown, the dynamic track stabilization immediately follows the track correction so that the repositioned track is stabilized in its correct position before it is subjected to train traffic.

Two track stabilization units 9, 10 are arranged on frame 8 spaced from each other in the direction of track elongation between the undercarriages. Each track stabilization unit includes a chassis (14 of unit 9 and 15 of unit 10) having rail engaging and guiding means illustrated as flanged wheels 16, 16 associated with each of the rails and mounting the chassis for mobility on the track. Hydraulic drives 12, 12 are associated with each rail and connect each chassis to frame 8, the cylinder of the hydraulic drives being pivoted to the frame and the piston rod being pivoted to the chassis. The hydraulic drives operate as load means supplemental to the weight of the apparatus for imparting a pressure to both rails of the track in the direction of the ballast bed whereby the track is pressed to a lower level. Each chassis carries vibrators 13 for producing at least approximately horizontal vibrations and these vibrations are imparted to the track through flanged wheels 16, hydraulic drive 17 laterally pressing cooperating pairs of flanged wheels 16, 16 associated with each rail without play against the rail with which they are associated while hydraulic drives 18 simultaneously lock the other pair of cooperating flanged wheels 16, 16 into play-free engagement with the associated rails. The structure of the track stabilization units is more fully described and illustrated in my above-mentioned patent application whose disclosure is herein incorporated by reference.

The two illustrated vibrators for each unit are coupled by a cardan shaft to a hydraulic motor so that they swing in phase, which will assure a uniform and solid compaction of the ballast without placing undue stress on the frame.

Figure 2:
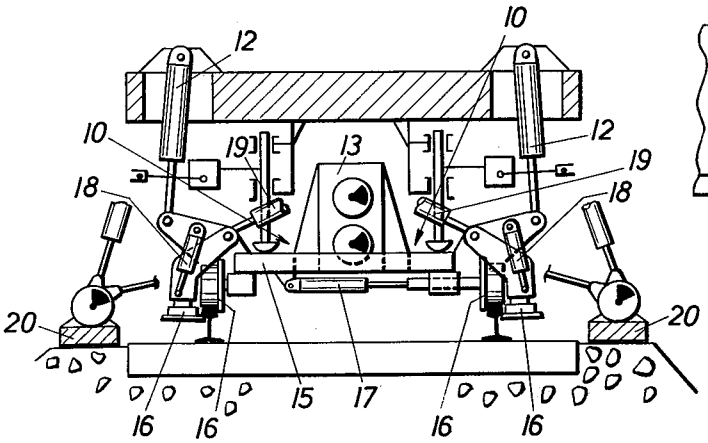
FIG. 2 is a sectional view of the track stabilization apparatus along line II—II of FIG. 1.

As shown in FIG. 2, the chassis of the track stabilization unit is connected to frame 8 by lining motors 19 so that the chassis, in play-free engagement with the track rails, may be laterally moved into a desired direction for lining the track. Furthermore, additional vibratory surface tampers 20 are adjustably mounted on apparatus frame 8 for tamping lateral strips of ballast adjacent the track, these parts being omitted from FIG. 1 for the sake of clarity.

FIG. 1 shows a reference 21 for controlling the level and alignment of track 4 in the region of track stabilization in a manner conventional in track surfacing, and the chassis of the track stabilization units are linked to undercarriages 7, 7 by suitable rods for movement of the units with apparatus frame 8.

Figure 3:
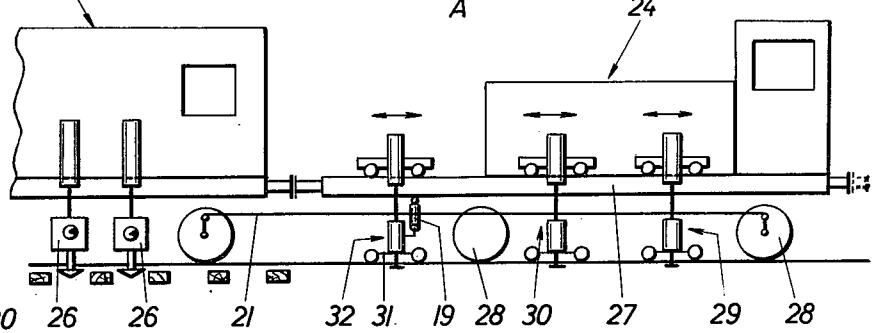
FIG. 3 is a schematic side view showing the combination of a track stabilization apparatus with a crib tamper.

FIG. 3 is representative of one preferred embodiment of the invention wherein a frame with two undercarriages is mounted on the track for mobility thereon in a working direction, at least one track stabilization unit is mounted on the frame between the two undercarriages and at least one track stabilization unit is mounted on the frame outwardly of the undercarriages. Preferably, one of the track stabilization units is mounted on the frame adjacent and rearward of a rear one of the undercarriages, in the working direction, a track lining means is associated with the one track stabilization unit, and a reference system is provided for controlling the track lining means. By arranging an undercarriage between the track stabilization units and thus increasing the downward pressure on the track, the efficiency of the stabilization is increased while enhancing the quality of the ballast compaction, particularly if the undercarriage and stabilization units are closely adjacent. Furthermore, the preferred embodiment makes it possible simultaneously to control the lining of the track and to effectuate any required residual lining due to the settling of the track during the simultaneous stabilization of the ballast bed.

Referring to the specific embodiment of FIG. 3, there is shown a track stabilizing apparatus 24 coupled to, and preceding in the working direction, a track tamper 25. The track tamper carries vibratory surface crib tampers 26 and may also carry additional surface tampers (not shown) for tamping portions of the ballast bed laterally adjacent the track. The track stabilizing apparatus comprises frame 27 mounted on two undercarriages 28, 28 for mobility on the track. Two track stabilization units 29, 30 are mounted on the frame between the front and rear undercarriage, and track stabilization unit 32 is mounted on the frame adjacent and rearward of rear undercarriage 28, the working direction of the apparatus being indicated by arrow A. As indicated, by double-headed arrows, the three track stabilization units are mounted on frame 27 by trolleys permitting the units to be shifted in the direction of track elongation so as to change their mutual spacing and their respective spacing from the undercarriages. In this manner, the adaptability of this three-unit stabilizer is further increased.

As illustrated, rear track stabilization unit 32 incorporates track lining motor 19 enabling this unit to be used as a track lining means in the manner hereinabove explained in connection with FIG. 2, the lining being controlled by reference system 21.

The three-unit stabilizer makes it possible to work on an extended length of track without subjecting any one point to excessive stabilizing forces which may damage the track, particularly the rail fastening elements.

In the illustrated embodiment, the frames for stabilizing apparatus 24 as tamper 25 are self-propelled and each has its own control cabin so that the two machines may be used separately and independently, if desired, depending on the surfacing requirements and thus increasing the economic usefulness of the machinery. The combined tamper and track stabilizing apparatus may be used on a non-stop surfacing operation.

Figures 4, 5, 6:
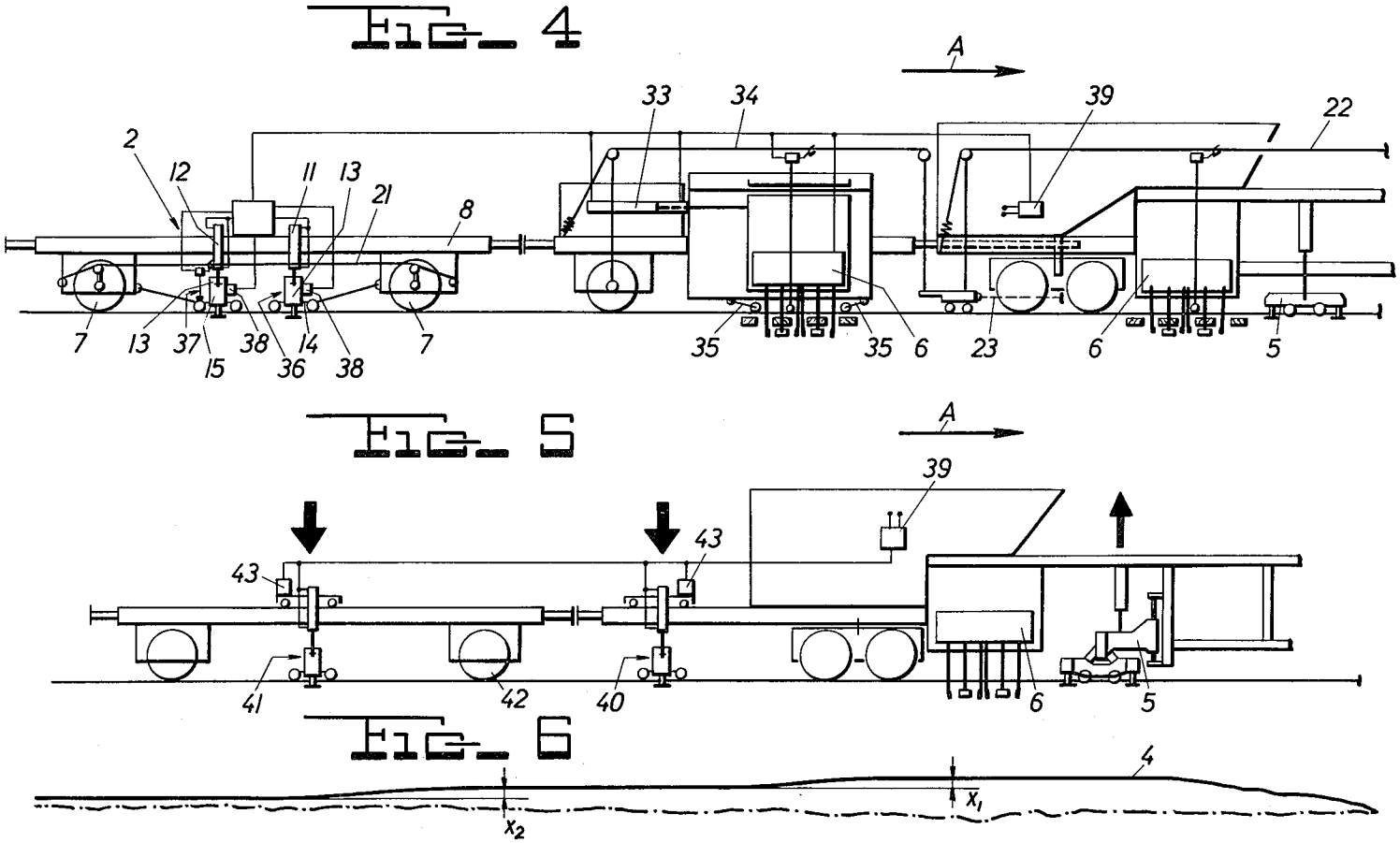
FIG. 4 is a side view of yet another embodiment showing a four-tie tamper combined with a track stabilization apparatus.
FIG. 5 is a side view showing a further embodiment of a combined track tamper and stabilizer.
FIG. 6 shows a schematic profile of a track surfaced with the machine combination of FIG. 5.

FIGS. 4 and 5 illustrate further preferred arrangements which include a track tamping machine including at least two tamping units each arranged to tamp one track tie, and the number of the track stabilization units corresponding to the number of tamping units. This provides great adaptability of the track stabilization to the track tamping, which precedes the stabilization in the working direction, in respect of the required stabilization time and the required magnitude of the stabilizing forces.

For tracks subjected to high traffic density and high train speeds, and whose track spacing is relatively uniform, it will be very advantageous to combine a track tamping machine having two tamping tool assemblies each arranged for tamping two track ties simultaneously with two track stabilization units arranged rearwardly of a rear undercarriage of the tamping machine. This two-tie tamping and double stabilization assure high efficiency while maintaining the quality of the surfacing. If the rearmost stabilizing unit incorporates a track lining arrangement, as hereinabove described, final lining of the settled and stabilized track may be effected.

The track surfacing apparatus of FIG. 4 moves in the direction of arrow A during surfacing operations. The track stabilization apparatus 2 is coupled to, and follows, a track leveling, lining and tamping machine. This machine comprises a first frame which runs on undercarriages of which only the rear undercarriage is shown in FIG. 4 and a second frame whosefront end is coupled to the first frame and supported thereby while a rear undercarriage supports the rear end of the second frame. Each frame supports a tamping tool assembly 6, each of the assemblies being of the known type arranged for tamping two track ties simultaneously, a forward one of the tamping tool assemblies 6 being mounted on the first frame forwardly of a front one of the undercarriages of the combined frames, in the working direction, while the other tamping tool assembly is mounted on the second frame between the two undercarriages of the combined frames. The first frame also supports track lifting and lining unit 5 whose operation is controlled by reference systems 22 and 23 in a well known manner. The carrier for the rear tamping tool assembly 6 is mounted on the second frame for movement in the direction of track elongation, a hydraulic motor 33 being coupled to the tamping tool assembly carrier for moving it in relation to the frame so as to make a desirable positioning of the tamping tool assembly above a selected group of ties possible. The track position at the second frame is controlled by further reference 34 and the track may be held in a corrected position by track engaging devices 35 in a manner forming no part of the present invention and disclosed, for instance, in German Offenlegungsschrift (Published Application) No. 2,114,281.

A track stabilization apparatus similar to that of FIG. 1 is coupled to the tamper. This apparatus carries two track stabilization units 36, 37 vibrator 13 of each unit having its own drive 38. Otherwise, the reference numerals designating parts in apparatus 2 are the same as in FIG. 1 so that a further description is not required. All drives are hydraulic, permitting operation of the stabilization units from central control 39 arranged on the tamper.

Drives 38 for the vibrators and the eccenters thereof, as well as hydraulic motors 11, 12, which apply a load to the track rails, may be so arranged that the vibrators produce oscillations having a frequency of $f =$ Hz at a variable oscillating force between 3500 and 5390 kp per eccenter, while the hydraulic motors apply a static load of 2430 kp, the pressure in the hydraulic circuit being, for instance, 120 atmospheres and the cylinder bores of the motor cylinders being 50.8 mm.

In the arrangement of FIG. 5, the forward track leveling, lining and tamping machine also includes double-tie tamping tool assembly 6 and track lifting and lining unit 5. A track stabilization unit 40 is mounted on the frame of the machine rearwardly of the rear undercarriage on which the machine runs on the track in the direction of arrow A. A second frame running on undercarriages 42 is coupled to the machine and track stabilization unit 41 is mounted on this second frame between the undercarriages thereof for mobility along the frame in the direction of track elongation. As in the other embodiments, this combined tamper and stabilizer also has reference systems controlling the track positioning but, to avoid redundancy, they have not been illustrated in FIG. 5.

The level of a track surfaced with the apparatus of FIG. 5 is illustrated in FIG. 6. Track lifting unit 5 raises track 4 to a desired grade determined by the reference system and the track is fixed in the leveled position by the use of tamping tool assembly 6 tamping ballast under the raised ties of the track. The succeeding track stabilization units 40 and 41 settle the track by amounts $x_1$ and $x_2$ while the exact grade and lining is maintained by suitable reference systems associated with the track stabilization, settling of the track and its corresponding stabilization being accomplished by subjecting the track to substantially horizontal vibrations, for instance of a frequency of 35 Hz and a total oscillating force of about 14,000 kp, with the simultaneous application of vertical pressures having a force of about 10 tons, for example. In this manner, the ballast supporting the track is homogenized, i.e. its density is more or less equalized. This controlled settling of the track by operation of units 40 and 41, whose combined horizontal vibrations and downward pressure is much more intensive than the forces applied by passing trains, anticipates the strong settling otherwise caused by the first trains passing over a newly corrected track so that the previously experienced unevenness of such track is avoided.

Since track stabilization units 40 and 41 may be moved by drives 43 in relation to undercarriage 42 positioned therebetween, they may be placed closely enough to the undercarriage, if desired, to permit the load applied by the undercarriage to participate in the track stabilization effected by these units, thus cooperating with them in suitably settling the track.

Central control 39 makes it possible constantly to control the vibratory and pressure forces transmitted to the track so as to adapt the settling and consequent stabilization of the surfaced track to expected train loads. At the same time, this central control permits drives 38 to be synchronized so that the vibrators of paired stabilization units 36, 37, for example, swing in phase. The central control gains in importance in situations where the combined apparatus must stand still at a given location. In this case, the control is operated to stop hydraulic fluid flow to drives 38, 11 and 12 of the track stabilization units so as to discontinue their operation and prevent the track from being depressed below a desired level.

I claim:

1. In a mobile apparatus for compacting ballast of a ballast bed supporting a track consisting of two rails fastened to ties resting on the ballast, each rail having a rail head with an upper surface and a side face, the apparatus comprising means for determining a deviation of the track position from a desired level: at least two track stabilization units spaced from each other in the direction of track elongation, each unit including a chassis mounted for mobility on the track on two undercarriages spaced from each other in the direction of track elongation, each undercarriage having rail engaging and guiding means associated with each of the rails, said means comprising rollers engaging the upper surfaces of the rail heads and guide elements engaging the side faces of the rail heads and cooperating with the rollers, means for imparting at least approximately horizontal vibrations to a section of the track engaged by the rail engaging and guiding means, the vibration imparting means including the rails engaging and guiding means and a vibration producing means arranged on the chassis, means associated with the rail engaging and guiding means for simultaneously laterally pressing the guiding elements associated with each rail without play against the rail with which they are associated, the pressing means and the vibration producing means being arranged on the chassis for vibration in unison whereby the rail engaging and guiding means transmit the vibration to the track section, and load means in the region of the vibration imparting means for imparting a pressure to both rails of the track in the direction of the ballast bed whereby the track is pressed to a lower level.

2. In the mobile apparatus of claim 1, a frame with two undercarriages mounted on the track for mobility thereon in a working direction, at least one of the track stabilization units being mounted on the frame between the two undercarriages and at least one of the track stabilization units being mounted on the frame outwardly of the undercarriages.

3. In the mobile apparatus of claim 2, one of the track stabilization units being mounted on the frame adjacent and rearward of a rear one of the undercarriages, in the working direction, track lining means associated with the one track stabilization unit, and a reference system for controlling the track lining means.

4. In the mobile apparatus of claim 1, a track tamping machine including at least two tamping units, each unit being arranged to tamp one track tie, and the number of the track stabilization units corresponding to the number of tamping units.

5. In the mobile apparatus of claim 4, two of said tamping units being associated to form a tamping tool assembly arranged for tamping two track ties simultaneously, and two of said track stabilization units being arranged rearwardly of the tamping tool assemblies, in a working direction.

6. In the mobile apparatus of claim 1, a track tamping machine including frame means with two undercarriages mounted on the track for mobility thereon in a working direction, two tamping tool assemblies each arranged for tamping two track ties simultaneously, one of the tamping tool assemblies being mounted on the frame means forwardly of a front one of the undercarriages, in the working direction, and the other tamping tool assembly being mounted on the frame means between the two undercarriages, and two of said track stabilization units being arranged rearwardly of a rear one of the undercarriages, in the working direction.

7. In the mobile apparatus of claim 1, three of the track stabilization units being spaced from each other in the direction of track elongation.

8. In the mobile apparatus of claim 1, an apparatus frame mounted for mobility on the track and at least one of the track stabilization units being mounted on the apparatus frame for mobility along the frame in the direction of track elongation.

9. In the mobile apparatus of claim 1, a self-propelled vehicle frame supporting the track stabilization units.

10. In the mobile apparatus of claim 1, the vibration producing means arranged on the chassis of both units being arranged to impart to the track vibrations in phase.

* * * * *